United States Patent [19]

Bendfeld

[11] Patent Number: 4,802,322

[45] Date of Patent: Feb. 7, 1989

[54] PORTABLE DIKE SYSTEM

[76] Inventor: Dwayne Bendfeld, Box 6, Site 6, R.R. 1, St. Albert, Alberta, Canada, T8N 1M8

[21] Appl. No.: 52,831

[22] Filed: May 21, 1987

[30] Foreign Application Priority Data

Feb. 27, 1987 [CA] Canada ..... 530867

[51] Int. Cl.[4] ..... E04C 2/04

[52] U.S. Cl. ..... 52/601; 52/582; 52/604

[58] Field of Search ..... 52/578, 579, 583, 587, 52/600, 601, 604, 589, 588, 582, 581

[56] References Cited

U.S. PATENT DOCUMENTS

| | | | |
|---|---|---|---|
| 992,739 | 5/1911 | Meier | 52/601 |
| 1,416,943 | 5/1922 | Broughton | 52/601 |
| 1,803,390 | 5/1931 | Howard | 52/601 |
| 2,338,246 | 1/1944 | Hoge | 52/589 |
| 2,986,848 | 6/1961 | Greene | 52/601 |
| 3,381,483 | 5/1968 | Huthsing, Jr. | 52/601 |
| 3,604,174 | 9/1971 | Nelson, Jr. | 52/601 |
| 3,760,540 | 9/1973 | Latoria et al. | 52/601 |
| 4,575,984 | 3/1986 | Versteeg | 52/583 |

FOREIGN PATENT DOCUMENTS

| | | |
|---|---|---|
| 235398 | 11/1923 | Canada . |
| 652536 | 11/1962 | Canada . |
| 787097 | 6/1968 | Canada . |
| 1124541 | 6/1982 | Canada . |

*Primary Examiner*—Michael Safavi

*Attorney, Agent, or Firm*—Davis, Bujold & Streck

[57] ABSTRACT

An environmental control dike system comprising a plurality of precast sections, each having a rectangular metal frame with a top and a bottom horizontal member, a first vertical end member joining the top and bottom horizontal members, the first vertical end member at a first end of the frame having an extension which extends longitudinally beyond the top and bottom horizontal members, the extension having a plurality of spaced openings adapted to receive the shank of a bolt, and a second vertical end member joining the top and bottom horizontal members at a second end of the frame, the second vertical end member having a plurality of threaded openings such that one of the sections may be secured to an adjacent section by passing a bolt through the openings in the longitudinal extension at the first end of the concrete section and threadedly engaging the bolt in the threaded opening at the second end of the adjacent section; a plurality of vertical reinforcing bars, one end of the vertical reinforcing bars being attached to the top horizontal member and the other end of the vertical reinforcing bar being attached to the bottom horizontal member of the frame; a plurality of horizontal reinforcing bars, one end of the horizontal reinforcing bars being attached to the first vertical end member and the other end being attached to the second vertical end member of the frame; and a concrete filler material covering the vertical and horizontal reinforcing bars.

15 Claims, 4 Drawing Sheets

PORTABLE DIKE SYSTEM

The present invention relates to a portable and reusable environmental control dike system.

BACKGROUND OF THE INVENTION

There is a need for portable environmental control dike installations in areas where the activities of man pose a threat to the environment. One such example are the many sites across North America, where oil, salt water, fuel or other corrosive chemicals are stored in large tanks. When one of these tanks ruptures, the contents are spewed forth with disastrous consequences to the environment. Companies which maintain such facilities undertake periodic maintenance and replacement of the tanks, and as a further precaution build a dike to confine any toxic substances which would be released should the tank rupture. Prior to the development of the present invention all dikes were of a permanent nature constructed in the form earthen berms, or concrete construction. The disadvantages of a permanent installation of this type are that they are costly, must be destroyed in order to access the site to replace storage tanks and form a permanent scar on the environment.

In order to achieve the desired object of having a portable environmental control dike system the present invention uses free standing concrete panels. It is well known in the art that the ability of concrete to sustain an impact is extremely limited. Prior to the present invention one skilled in the art would have been of the opinion that it would not be possible to have a dike system constructed of concrete panels which were free standing. In order to have free standing concrete panels which two fundamental problems must be solved, namely; the strength of the concrete panels and strength of the joints.

The closest prior art with respect to the concrete panels used in the present invention is Canadian Patent No. 235,398. This patent discloses a metal frame which encloses a concrete filler material. The metal frame has vertical reinforcing bars and an internal reinforcing mesh. Although this patent issued in 1923, concrete panels constructed in accordance with the teaching of this invention have never been used in dike construction, and would not suitable for such purpose without modification as concrete would pull away from the longitudinal edges of the frame resulting in leakage.

There are several prior dike systems which employ concrete panels, none of which are free standing. Utilizing a modified form of the concrete panels of Canadian Patent No. 235,398 taken in any permissible combination with these systems they are not capable of being adapted as free standing units to perform the task for which the present invention was designed.

Canadian Patent No. 787,097 entitled "pre-cast segment storage tank", discloses a liquid storage tank intended for an underground installation. The patent teaches that the pre-cast concrete segments should be assembled on a concrete slab. It also requires a plurality of support beams which are said to "interlock with the longitudinal side walls of the tank to positively stabilize and maintain the side walls in their parallel spaced-apart upright position". It is questionable whether this structure could be free standing in the absence of the soil support and the support beams. The pre-cast segment side panels are joined in tongue and groove engagement. This type of joint would not withstand the force if a 450 gallon tank full of toxic chemicals ruptured sending a torrent of fluids rushing against the joints of the side panels. This type of concrete construction is constructed on ground level would crack and leak as a consequence of the ground movement known as "frost heaving."

Canadian Patent No. 1,124,541 entitled "Multi-Purpose Precast concrete panels and methods of Constructing Concrete structures Employing the Same", discloses two methods of deploying concrete sections to form a dike. In the methods disclosed concrete is poured through openings in the base of the concrete panels to "integrate the bottoms of said groups (of panels) by a mass of concrete extending therebetween and through the bottom rectangular openings of said groups". Each group of panels is described as lying "against an adjacent earthen mass". The joints between the panels are described as being tongue and groove which are "aligned adjacent their uppermost or generally horizontal edges by means of one or more "U" shaped aligning and cinching bolts". Even with the cinching bolts the tongue and groove joints are not capable of withstanding the force which would be applied from a torrent of fluids from a ruptured tank.

SUMMARY OF THE INVENTION

The primary object of the present invention is to provide a cost effective environmental control dike system which is portable and reusable.

Broadly, the present invention provides an environmental control dike system which is comprised of a plurality of precast sections, each of the sections having a rectangular metal frame with a top horizontal member, a bottom horizontal member, a first vertical end member joining the top and bottom horizontal members, the first vertical end member at a first end of the frame having an extension which extends longitudinally beyond the top and bottom horizontal members, the extension having a plurality of spaced openings adapted to receive the shank of a bolt, and a second vertical end member joining the top and bottom horizontal members at a second end of the frame, the second vertical end member having a plurality of threaded openings such that one of the sections may be secured to an adjacent section by passing a bolt through the openings in the longitudinal extension at the first end of the concrete section and threadedly engaging the bolt in the threaded opening at the second end of the adjacent section; a plurality of vertical reinforcing bars, one end of the vertical reinforcing bars being attached to the top horizontal member and the other end of the vertical reinforcing bar being attached to the bottom horizontal member of the frame; a plurality of horizontal reinforcing bars, one end of the horizontal reinforcing bars being attached to the first vertical end member and the other end being attached to the second vertical end member of the frame; and a concrete filler material covering the vertical and horizontal reinforcing bars within the interior of the metal frame.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
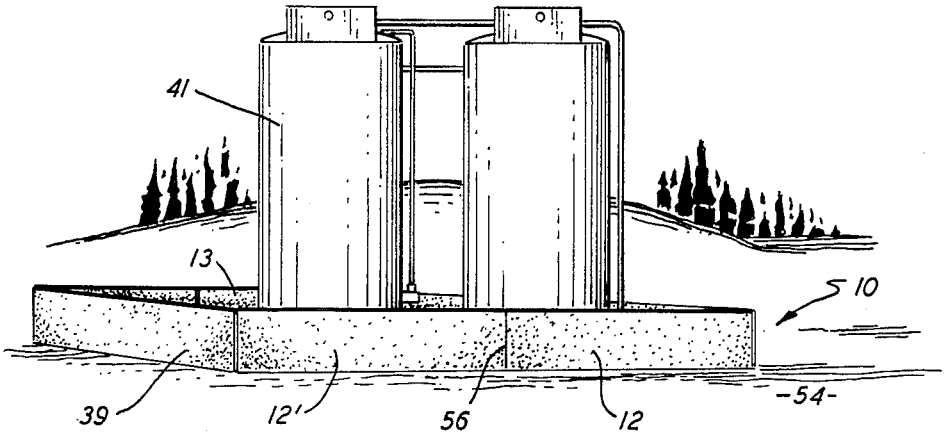
FIG. 1 is a pictorial view of a preferred embodiment of the invention.

The preferred embodiment will now be described with reference to FIGS. 1 through 9. Referring to FIG. 1, the preferred embodiment, generally designated by reference numeral 10, is an environmental control dike system which is comprised of a plurality of free standing precast sections 12 between 10 and 20 feet long, three feet high and three inches wide, joined to form a rectangular enclosure 13 on a ground surface 54.

It has been ascertained that sections 12 of dimensions between 10 and 20 feet long, three feet high and three inches wide are particularly suited for the intended purpose. The more the height of sections 12 exceeds three feet the greater the likelihood that dike system 10 will cease to be free standing and will need external bracing. Where the width of sections 12 is less than three inches one must be cautious of the volume of water to be contained as a section of a width of less than three inches may not have the requisite strength. A length of between 10 and 20 feet has been found to be ideal for purposes of handling sections 12. When dike system 10 is constructed of sections 12 it will be free-standing for a length of 40 feet. Structures over 40 feet in length will require external bracing.

Figure 2:
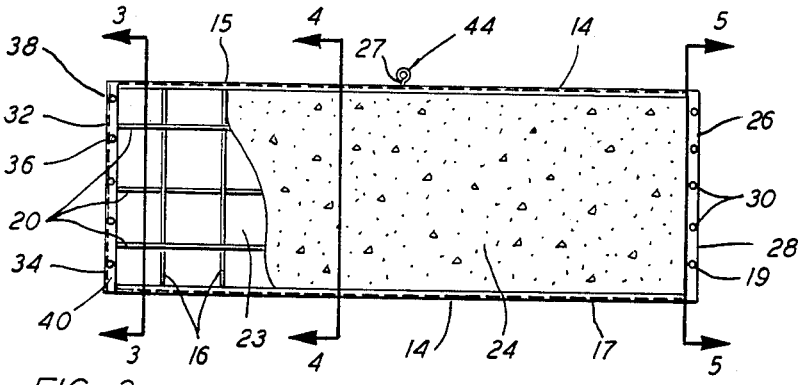
FIG. 2 is a side view partially cut away of one of the sections out of which the preferred embodiment of the invention illustrated in FIG. 1 is comprised.
Figure 3:
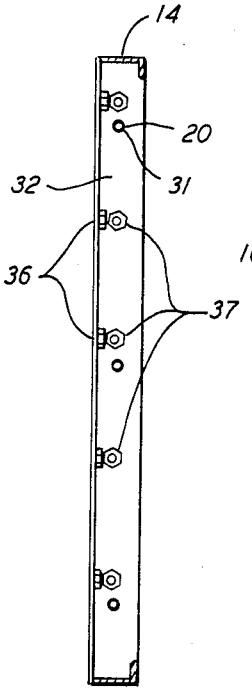
FIG. 3 is a cross-section view taken at section line 3—3 of FIG. 2.
Figure 4:
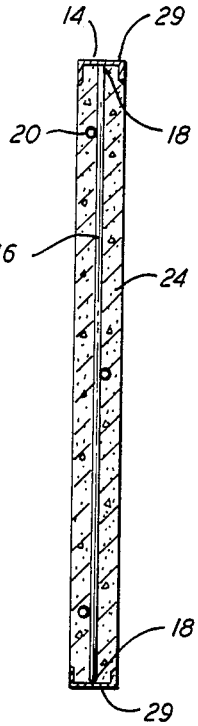
FIG. 4 is a cross-section view taken at section line 4—4 of FIG. 2.
Figure 5:
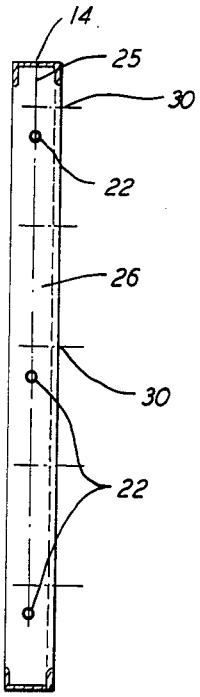
FIG. 5 is a cross-section view taken at section line 5—5 of FIG. 2.
Figure 6:
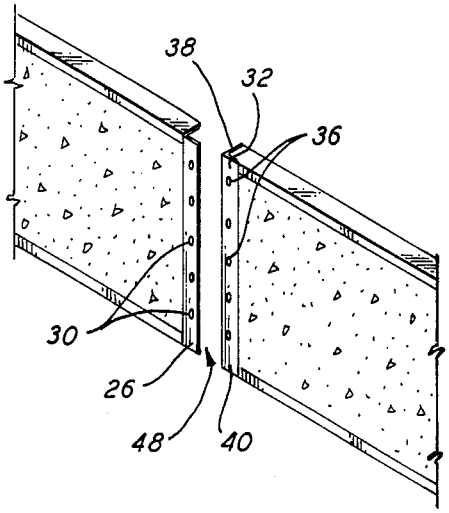
FIG. 6 is a perspective view of the longitudinal joining of two of the sections illustrated in FIG. 2.
Figure 7:
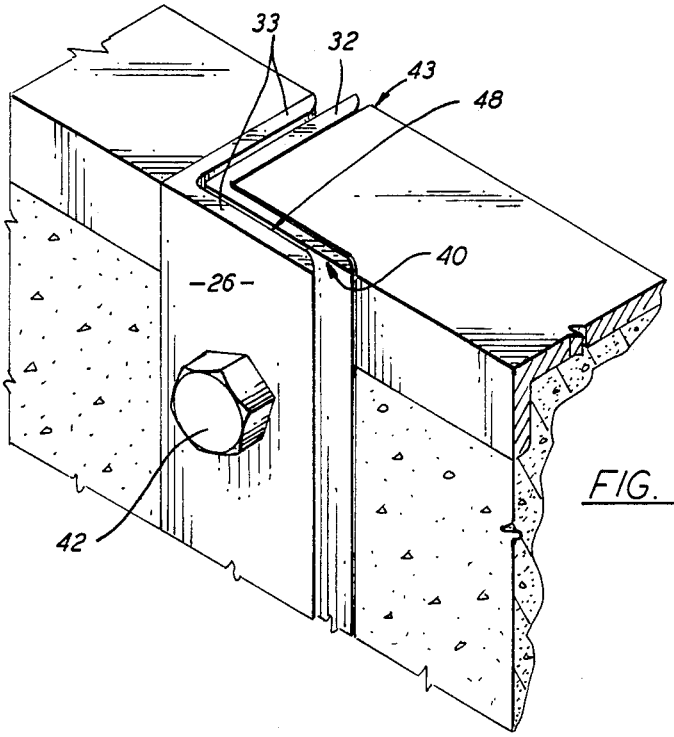
FIG. 7 is an enlarged perspective view of the longitudinal joining of two of the sections illustrated in FIG. 2.
Figure 8:
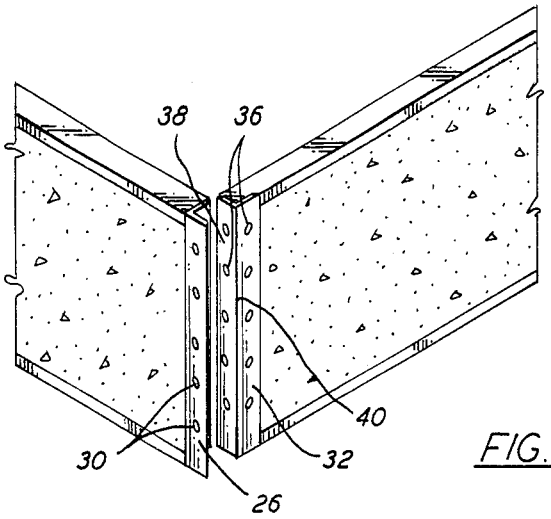
FIG. 8 is a perspective view of the joining of two of the sections illustrated in FIG. 2 to form a corner.
Figure 9:
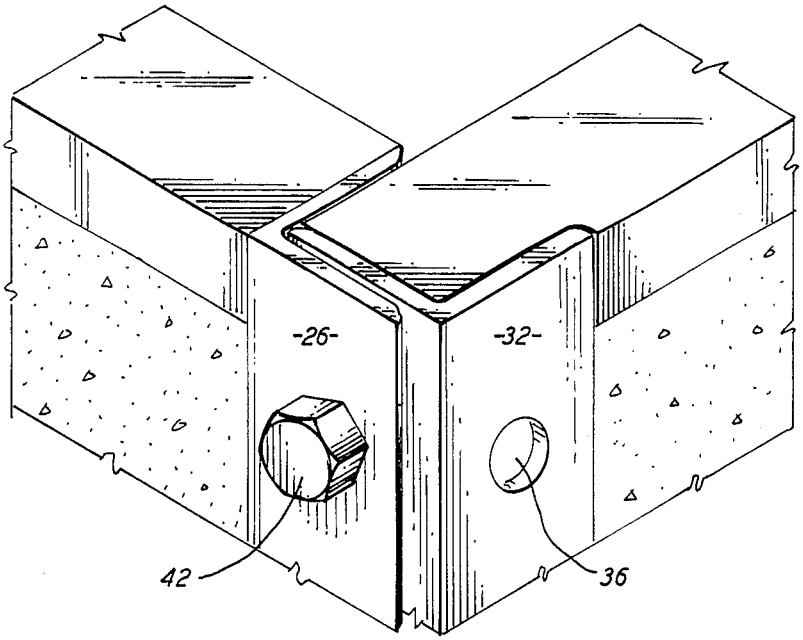
FIG. 9 is an enlarged perspective view of the joining of two of the sections illustrated in FIG. 2 to form a corner.

As is illustrated in FIG. 2, each of sections 12 is comprised of a rectangular metal frame 14 having top 15 and bottom 17 horizontal members, and first 19 and second 32 vertical end members which join top 15 and bottom 17 horizontal members to define an interior 23 of frame 14. Top 15 and bottom 17 horizontal members are made of channel iron with a channel portion 25 oriented toward interior 23 of frame 14. At a centre point 27 of top horizontal member 15 a metal ring 44 is attached to facilitate lifting sections 12 for purpose of installation and removal of rectangular enclosure 13. Top 15 and bottom 17 horizontal members have a plurality of holes 29 which are adapted to receive the ends 18 of vertical reinforcing bars 16. First 19 and second 32 vertical end members have a plurality of holes 31 which are adapted to receive the ends 22 of horizontal reinforcing bars 20. First vertical end member 19 at a first end 28 of frame 14 is made of angle iron with the two arms 33 of angle iron forming a right angle. One of the arms 33 of first vertical end member 19 forms an extension 26 which extends longitudinally beyond top 15 and bottom 17 horizontal members. Extension 26 has a plurality of spaced openings 30 adapted to receive a bolt 42. Second vertical end member 32 at a second end 34 of frame 14 has a plurality of spaced openings 36 behind which nuts 37 have been welded such that one of sections 12 may be secured to an adjacent section 12′ by passing bolt 42 through one of openings 30 in extension 26 at first end 28 of section 12 and through one of openings 36 of second vertical member 32 at a second end 34 of an adjacent section 12′ to threadedly engage bolt 42 in nut 37. Second vertical end member 32 has openings 36 in both an end 38 and a side 40 such that each of sections 12 may be joined longitudinally in end to end relation with an adjacent section 12′ as illustrated in FIGS. 6 and 7 or joined with an adjacent section 12′ to form a corner as illustrated in FIGS. 8 and 9.

Extension 26 of first vertical end member 19 should always be placed to the exterior 39 of enclosure 13 when constructing dike system 10. The force of a torrent of fluid from a ruptured fuel tank 41, has such force that if such force was exerted at a longitudinal joint 56 between sections 12 and directly against extension 26, extension 26 would serve as a pivot point between section 12 and the adjacent section 12′ and would bend. When such force is exerted on a side 43 of joint 56 opposed to extension 26, extension 26 serves as a pivot point as well, however first vertical end member 19 of first section 12 moves against second vertical end member 32 of section 12′ creating a tighter sealing engagement between sections 12 and 12′. Extension 26 can withstand the force only because with the two sections 12 and 12′ abutting there is no room for movement.

Within the interior 23 of frame 14 are a plurality of horizontal 20 and vertical 16 reinforcing bars. Ends 18 of vertical reinforcing bars 16 are welded in holes 29 of top 15 and bottom 17 horizontal members. Horizontal reinforcing bars 20 are interwoven with vertical reinforcing bars 16. Ends 22 of horizontal reinforcing bars are welded in holes 31 of first 19 and second 32 vertical end members. A concrete filler material 24 covers vertical 16 and horizontal 20 reinforcing bars within interior 23 of frame 14. The reinforcing bars 16 and 20 are necessary to give the concrete filler material additional strength. The vertical reinforcing bars 16 are welded to frame 14 as otherwise concrete filler 24 would pull away from frame 14 when section 12 was lifted by metal ring 44. The horizontal reinforcing bars 20 are welded to frame 14 as otherwise concrete fillter 24 would pull away from frame 14 as a result of stress during transport, frost heaving of ground surface 54 or impact by a torrent of fluids. Although sulfurcrete is a new product which is expensive to produce at this time, sulfurcrete is an alternate type of concrete usable.

In order to construct dike system 10 using sections 12 the site must first be roughly levelled with a bulldozer. Once the site has been prepared, sections 12 are deployed in end to end relation around the perimeter of rectangular enclosure 13. Concrete sections 12 are hauled to the site by truck and lifted in place using a truck mounted crane (not shown). The crane lifts sections 12 by metal ring 44. A caulking compound such as silicon is applied to the interior face 48 of extension 26 and then extension 26 is bolted to second vertical end member 32 using bolts 42 which are passed through opening 30 of extension and openings 36 on end 38 or side 40 of second vertical end member 32 to threadedly engage nut 37. The weight of concrete sections 12 causes a seal to be formed with the ground surface 54 upon which dike system 10 rests. The joints 56 formed between extension 26 of section 12 and second vertical end member 32 of section 12′ permits limited movement in order that dike system 10 can respond to movement of ground surface 54 without disrupting the seal between the ground surface 54 and sections 12. The caluking material chosen must be flexible in order to permit movement at joint 56 without leaking.

The embodiments of the invention in which an exclusive property or privilege is claimed are defined as follows:

1. An environmental control dike system, comprising:

a. a plurality of precast sections, each of said sections comprising:

i. a rectangular metal frame having a top horizontal member, a bottom horizontal member, a first vertical end member joining said top and bottom horizontal members, said first vertical end member at a first end of said frame having an extension which extends longitudinally beyond said top and bottom horizontal members, said extension having a plurality of spaced openings adapted to receive the shank of a bolt, and a second vertical end member joining said top and bottom horizontal members at a second end of said frame, said second vertical end member having a plurality of threaded openings such that one of said sections may be secured to an adjacent section by passing a bolt through said openings in said longitudinal extension at said first end of said section and threadedly engaging said bolt in said threaded opening at said second end of said adjacent section; said second vertical end member having threaded openings in both an end and a side such that each of said sections may be joined longitudinally in end to end relation with an adjacent section or joined with an adjacent section to form a corner;

ii. a plurality of vertical reinforcing bars, one end of said vertical reinforcing bars being attached to said top horizontal member and the other end of said vertical reinforcing bars being attached to said bottom horizontal member of said frame;

iii. a plurality of horizontal reinforcing bars, one end of said horizontal reinforcing bars being attached to said first vertical end member and the other end being attached to said second vertical end member of said frame;

iv. a concrete filler material covering said vertical and horizontal reinforcing bars.

2. The dike system as defined in claim 1, wherein a plurality of said sections are joined to form a rectangular enclosure thereby defining an interior and exterior, said longitudinal extension of said first vertical end member of each section being placed to the exterior of said enclosure and serving as a pivot point such that upon a force being exterted on the interior of said joint, said first vertical end member of each of said sections is forced into tighter sealing engagement with said second vertical end member of said adjacent section.

3. The dike system as defined in claim 1, wherein the dimensions of said sections are between 10 and 20 feet long, three feet high and three inches wide.

4. The dike system as defined in claim 1, wherein means are attached to said top horizontal member of said frame to facilitate lifting said sections for purposes of installation and removal.

5. The dike system as defined in claim 1, wherein each of said horizontal members are made of channel iron, the channel portion of the top horizontal members oriented toward the channel portion of the bottom horizontal members.

6. The dike system as defined in claim 1, wherein said first vertical member is made of angle iron with the two arms of said angle iron forming a right angle, one of said arms forming an extension which extends longitudinally beyond said top and bottom horizontal members, said extension having a plurality of spaced openings adapted to receive the shank of a bolt.

7. The dike system as defined in claim 1, wherein said second vertical end member has spaced openings behind which nuts have been welded to form a threaded opening.

8. The dike system as defined in claim 1, wherein said horizontal reinforcing bars are interwoven with said vertical reinforcing bars.

9. The dike system as defined in claim 4, wherein said means to facilitate lifting said sections for purposes of installation and removal being a metal ring attached to the centre point of said top horizontal member of said metal frame.

10. An environmental control dike system, comprising:

a. a plurality of precast sections joined to form a rectangular enclosure having an interior and an exterior, each of said sections comprising:

i. a rectangular metal frame having top and bottom horizontal members, and first and second vertical end members joining said top and bottom horizontal members to define an interior of said frame, said top and bottom horizontal members being made of channel iron the channel portion of which is oriented toward said interior of said frame, said top horizontal member having means to facilitate lifting said sections for purposes of installation and removal, said first vertical end member at a first end of said frame being made of angle iron with the two arms of said angle iron forming a right angle, one of said arms forming an extension which extends longitudinally beyond said top and bottom horizontal members, said extension having a plurality of spaced openings adapted to receive the shank of a bolt, said second vertical end member at a second end of said frame having a plurality of spaced openings behind which nuts have been welded to form threaded openings such that one of said sections may be secured to an adjacent section by passing a bolt through said openings in said longitudinal extension at said first end of said section and threadedly engaging said bolt in said threaded opening at said second end of said adjacent section, said longitudinal extension of said first vertical end member of each of said sections being placed to the exterior of said enclosure and serving as a pivot point such that upon a force being exterted on the interior of said joint, said first vertical end member of each of said sections is forced into tighter sealing engagement with said second vertical end member of said adjacent section;

ii. a plurality of vertical reinforcing bars, one end of said vertical reinforcing bars being attached to said top horizontal member and the other end of said vertical reinforcing bars being attached to said bottom horizontal member of said frame;

iii. a plurality of horizontal reinforcing bars, one end of said horizontal reinforcing bars being attached to said first vertical end member and the other end being attached to said second vertical end member of said frame; and iv. a concrete filler material covering said vertical and horizontal reinforcing bars.

11. The dike system as defined in claim 10, wherein the dimensions of said sections are between 10 and 20 feet long, three feet high and three inches wide.

12. The dike system as defined in claim 10, wherein said second vertical end member has threaded openings in both an end and a side such that each of said sections may be joined longitudinally in end to end relation with an adjacent section or joined with an adjacent section to form a corner.

13. The dike system as defined in claim 10, wherein said horizontal reinforcing bars are interwoven with said vertical reinforcing bars.

14. The dike system as defined in claim 10, wherein said means to facilitate lifting said sections for purposes of installation and removal being a metal ring attached to the centre point of said top horizontal member of said metal frame.

15. An environmental control dike system, comprising:

a. a plurality of precast sections between 10 and 20 feet long, three feet high and three inches wide, joined to form a rectangular enclosure having an interior and an exterior, each of said sections comprising:

i. a rectangular metal frame having top and bottom horizontal members, and first and second vertical end members joining said top and bottom horizontal members to define an interior of said frame, said top and bottom horizontal members being made of channel iron with a channel portion oriented toward said interior of said frame, a centre point of said top horizontal member having a metal ring attached to facilitate lifting said sections for purposes of installation and removal, said top and bottom horizontal members and said first and second vertical end members having a plurality of holes, said first vertical end member at a first end of said frame being made of angle iron with the two arms of said angle iron forming a right angle, one of said arms forming an extension which extends longitudinally beyond said top and bottom horizontal members and having a plurality of spaced openings adapted to receive the shank of a bolt, said second vertical end member at a second end of said frame having a plurality of spaced openings behind which nuts have been welded to form threaded openings such that one of said sections may be secured to an adjacent section by passing a bolt through said openings in said longitudinal extension at said first end of said section and threadedly engaging said bolt in said threaded opening at said second end of said adjacent section, said second vertical end member having threaded openings in both an end and a side such that each of said sections may be joined longitudinally in end to end relation with an adjacent section or joined with an adjacent section to form a corner, said longitudinal extension of said first vertical end member of each of said sections being placed to the exterior of said enclosure and serving as a pivot point such that upon a force being exerted on the interior of said joint, said first vertical end member of each of said sections is forced into tighter sealing engagement with said second vertical end member of said adjacent section;

ii. a plurality of vertical reinforcing bars, one end of said vertical reinforcing bars being welded in said holes of said top horizontal member and the other end of said vertical reinforcing bars being welded in said holes of said bottom horizontal-member of said frame;

iii. a plurality of horizontal reinforcing bars interwoven with said vertical reinforcing bars, one end of said horizontal reinforcing bars being welded in said holes of said first vertical end member and the other end being welded in said holes of said second vertical end member of said frame; and iv. a concrete filler material covering said vertical and horizontal reinforcing bars.

* * * * *